US005495878A

United States Patent [19]

McKenen, Jr.

[11] Patent Number: 5,495,878

[45] Date of Patent: Mar. 5, 1996

[54] HAND HELD LOG SPLITTER

[75] Inventor: Robert E. McKenen, Jr., Hot Springs, Ark.

[73] Assignee: R.E.M. Incorporated, Hot Springs, Ark.

[21] Appl. No.: 402,537

[22] Filed: Mar. 10, 1995

[51] Int. Cl.[6] ..... B27L 7/00

[52] U.S. Cl. ..... 144/193 C; 144/193 R; 144/366

[58] Field of Search ..... 254/104; 125/23.01; 173/90; 144/193 R, 193 C, 193 D, 366

[56] References Cited

U.S. PATENT DOCUMENTS

| | | | |
|---|---|---|---|
| 3,519,234 | 7/1970 | Matson | 144/193 C |
| 3,735,822 | 5/1973 | Deike | 144/193 C |
| 4,280,540 | 7/1981 | Meacham | 144/193 C |
| 4,308,903 | 1/1982 | Alloway | 144/193 C |
| 4,327,787 | 5/1982 | Loratto | 144/193 D |
| 4,350,192 | 9/1982 | Dent | 144/193 C |
| 4,379,475 | 4/1983 | Nokes | 144/193 C |
| 4,405,005 | 9/1983 | Zanker | 144/193 D |
| 4,431,040 | 2/1984 | Friedrich et al. | 144/193 C |
| 4,458,415 | 7/1984 | Maher et al. | 144/193 C |
| 4,577,667 | 3/1986 | Gray et al. | 144/193 C |

*Primary Examiner*—W. Donald Bray

*Attorney, Agent, or Firm*—Stephen D. Carver; Trent C. Keisling

[57] ABSTRACT

A hand-operated, reciprocating slide hammer device for splitting wood or other workpieces. The splitter comprises an outer, elongated sleeve that internally receives a rigid, elongated tool control shaft. The sleeve is equipped with handles for gripping by a user so it may be first manually lifted upwardly and then forcibly drawn downwardly. An internal weight coaxially disposed at the sleeve top periodically slams the shaft when the sleeve is hammered downwardly. Alternate cutting tools including wedges, a root cutter, and an asphalt hammer, are disclosed. The selected tool is removably coupled to the shaft through a quick release collar system. The selected tool is manually placed in engagement with the workpiece, and thereafter pounded into the target as the sleeve vigorously hammers the shaft downwardly. Smooth, jam-free operation is insured by critical alignment guides disposed within an annulus between the shaft and the sleeve, and a venting orifice that facilitates periodic oiling.

11 Claims, 6 Drawing Sheets

HAND HELD LOG SPLITTER

BACKGROUND OF THE INVENTION

I. Field of the Invention

The present invention generally relates to hand held log splitters. More particularly, the present invention relates to telescoping log splitters of the type that impact and split wood (or other workpiece) by repeated upward and downward movements. Prior art patents relating to the subject matter can be found in U.S. Class 173, subclasses 90 and 91 and U.S. Class 144, subclass 193C.

II. Description of the Prior Art

It is well recognized by those skilled in the art that the best firewood results from logs that have been broken up or split. Usually logs to be burned in home fire places or wood-burning stoves is quartered into convenient sections. Although relatively larger logs can be used with modern wood burning stoves, they are easier to move and store if split or quartered. Accordingly it has long been recognized in the art that devices for splitting logs or portions of logs are advantageous.

While the prior art reflects various forms of powered devices for splitting wood, it is highly advantageous from a price and convenience standpoint to provide a completely manual device. The prior art reflects a number of arrangements where one or more pieces are fitted coaxially together so that a single operator can reciprocate them relative to each other. As one coaxial portion is reciprocated upwardly and downwardly, a weight associated with the apparatus forcibly impacts a lower tool which engages the log.

A sliding log splitter device as seen in U.S. Pat. No. 4,308,903. This log splitter includes a wedge shaped tool which impacts the log. The tool is attached to an upwardly extending rod received coaxially within the body of a reciprocating device. Weights within the top of the body ultimately make impact to provide a driving effect.

A similar reciprocal, hand held log splitter is seen in Meacham, U.S. Pat. No. 4,280,540. Nokes, U.S. Pat. No. 4,254,808, discloses a reciprocating device which is impacted by a hammer. Another reciprocating device is U.S. Pat. No. 4,327,787 wherein an outer pipe can be moved upwardly and downwardly over an inner shaft by a handle and various impact tools can be interchanged.

U.S. Pat. No. 3,519,087 shows a reciprocating device in which the rod projects outwardly coaxially from the outer sleeve and weights are disposed on the top. By reciprocating a device the weights impact the load to provide a driving function as generally described above.

U.S. Pat. No. 5,042,591 discloses a reciprocating fence post installer. It includes a central body adapted to be generally coaxially disposed over the post, and an impact mechanism having a handle which is reciprocated upwardly and downwardly relative to the body.

A stake driver in which reciprocal movement is employed is also seen in U.S. Pat. No. 5,085,281. Similar "slide" hammer stake driving devices are seen in U.S. Pat. Nos. 4,101,088, 5,042,591 and 5,085,281.

However "slide hammers" of this character can be very difficult to control. The point of impact must be carefully controlled for stability. Moreover, an acceptable device must be easily switched between transportation and use modes for safety. Further, it is important that the weight transferring mechanism be properly centered so that all of the implement components are carefully maintained in proper coaxial relationship. The latter construction can prevent twisting or binding forces from interfering with the smooth operation of the tool.

SUMMARY OF THE INVENTION

My hand-operated device can easily split wood or logs, and it can be used with interchangeable tools for a variety of other purposes.

In the best mode, my invention is used as a log splitter. The splitter comprises an outer, elongated sleeve equipped with handles for gripping by a user. A rigid, elongated tool control shaft is coaxially received within the sleeve. The sleeve and the shaft are telescopingly extended and retracted in use. A selected cutting tool such as a wedge or the like is removably coupled to the shaft emanating from the sleeve. The selected tool is manually placed in engagement with the workpiece, and thereafter pounded into the target as the sleeve vigorously hammers the shaft downwardly.

The rigid outer sleeve includes an internal weight coaxially disposed at its top. This weight periodically impacts the top of the shaft when the sleeve is forcibly drawn downwardly. Smooth operation of the shaft and sleeve is insured by critical alignment guides disposed within an annulus between the shaft and the sleeve.

My guide construction minimize twisting and binding forces to prevent jamming. An upper guide is coaxially secured to the top of the control shaft. The upper guide slides within the annulus as the sleeve slides relative to the shaft. A lower guide coaxially secured to the sleeve bottom is coaxially penetrated by the shaft. The upper and lower guides contact one another when the sleeve and shaft are maximally telescoped apart. The guides thus prevent the parts from separating when the sleeve is lifted as high as possible. An easy to use locking system temporarily secures the splitter in a retracted position ideal for transportation.

I have provided various tools for use with different workpieces. Any selected tool can be quick coupled to the control shaft through a quick release collar system. Separate tools are provided for splitting hard woods and softer wood or pines. Tools for cutting roots and for breaking up pavement are also disclosed. Each tool terminates in an upper nut that mates with a threaded stub projecting from the control shaft. A jam nut and lock washer are frictionally tightened against the upper nut to at least temporarily fasten the chosen tool. With a simple wrench the operator can quickly change between the desired tool.

Thus a primary object of my invention is to provide a highly stable and safe slide hammer for splitting logs and the like.

Another fundamental object of my invention is to provide a safe slide hammer for splitting logs.

Another object is to provide a slide hammer of the character described which can be disposed safely between transportation and usage positions or orientations.

Another object is to provide a highly reliable slide hammer in which the coaxial relationship of working parts is smoothly maintained.

Thus another object is to provide a slide hammer device of the character described which is inherently stable and easy to hold.

Another object is to provide a slide hammer of the character described which resists bending and binding.

Therefore another object is to minimize service requirements.

A further object is to provide a wood splitter that can be conveniently used by one person.

Another important object is to provide a manually operated wood splitter that telescopically extends or retracts without jamming.

Another object is to provide a slide hammer device of the character described that can employed with a variety of different tools for different purposes.

Another basic object is to provide a log splitting device that can be safely used and transported by a single workman.

Yet another important object is to provide a log splitter of the character described wherein the stability of all the parts is enhanced and the operator is not forced to assume an unstable or an unsafe position during use.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

Figure 1:
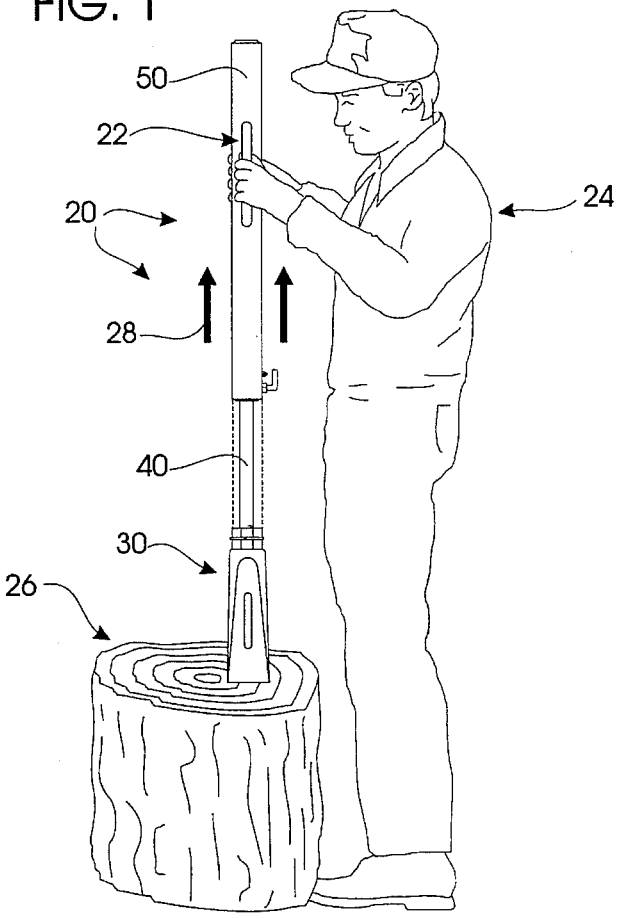
FIG. 1 is a pictorial view of my Hand-Held Log Splitter shown with the pieces telescoped apart.
Figure 2:
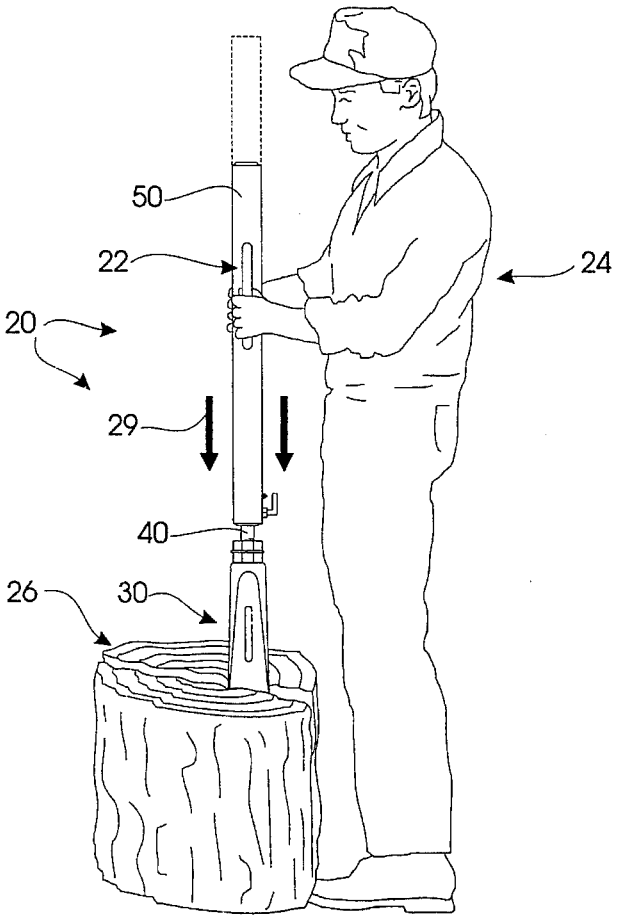
FIG. 2 is a pictorial view similar to FIG. 1, but showing the device disposed in an impact position.
Figure 3:
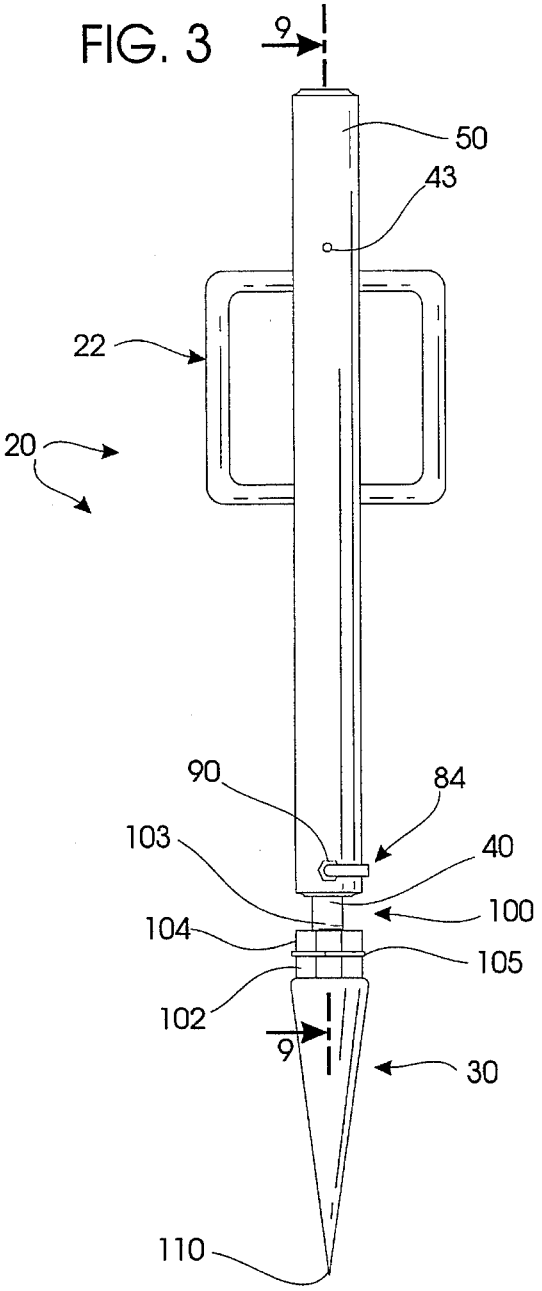
FIG. 3 is an front elevational view of the best mode.
Figure 4:
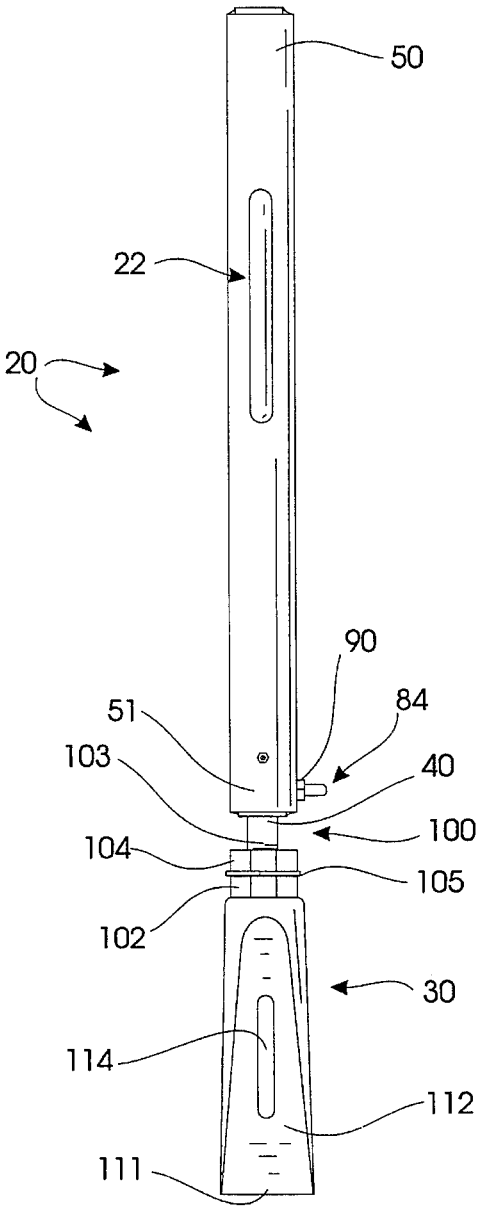
FIG. 4 is a side elevational view taken from a position generally from the left of FIG. 3.
Figure 5:
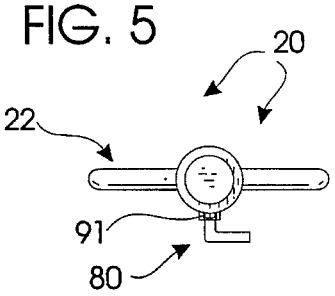
FIG. 5 is a top plan view taken from a position generally above FIG. 3.
Figure 6:
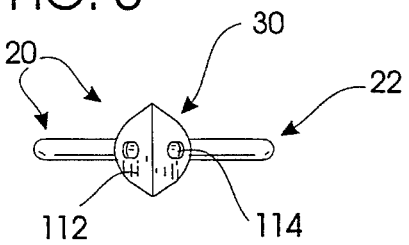
FIG. 6 is a bottom plan view taken from a position generally from the underside of FIG. 3.
Figure 10:
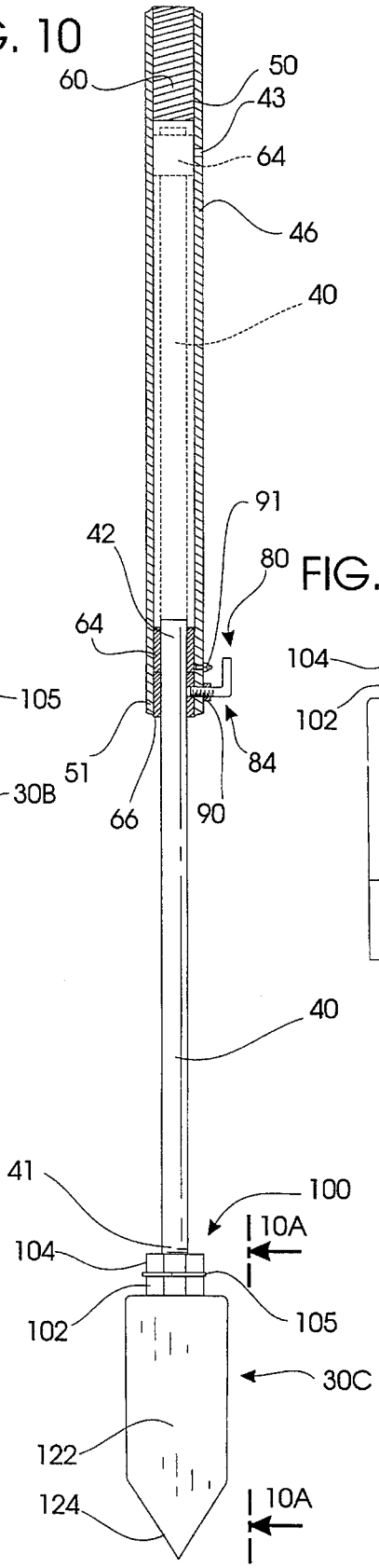
FIG. 10 is a longitudinal, sectional view taken generally along line 10—10 of FIG. 7 with moved positions indicated by dashed lines, and showing an alternative impact tool.
Figure 11:
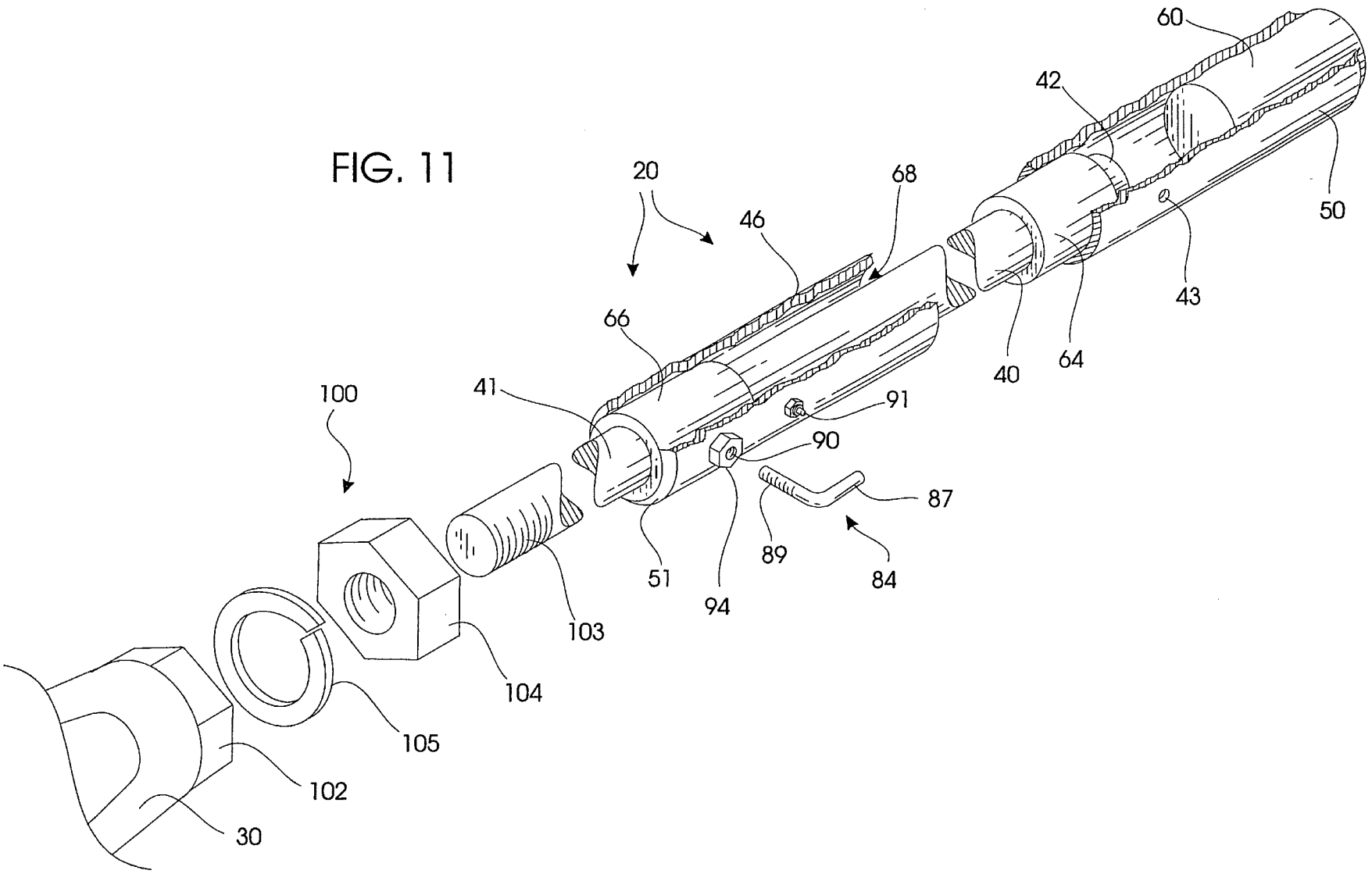
Figure 12:
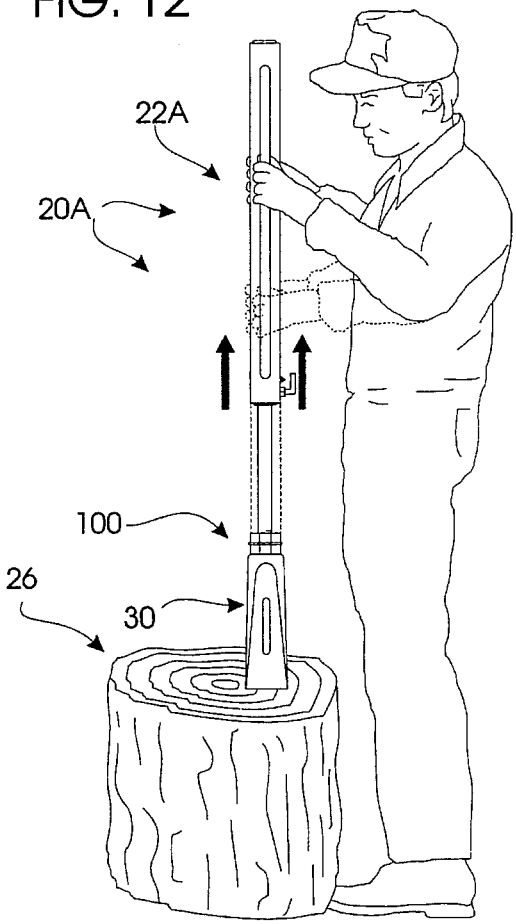
Figure 13:
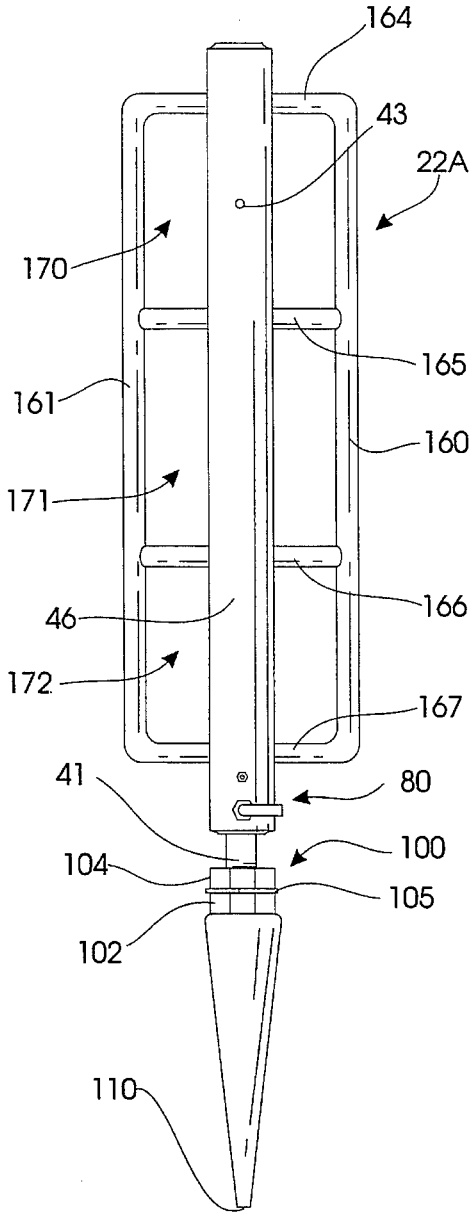

FIG. *10a* is a side elevational view of an alternative impact tool taken generally along line 10—10 of FIG. 10;

FIG. 11 is a partially exploded isometric view of the best mode with portions broken away or shown in section for clarity;

FIG. 12 is a pictorial view similar to FIGS. 1 and 2, showing an alternative embodiment; and, FIG. 13 is a side elevational view of the device of FIG. 12.

DETAILED DESCRIPTION

Referring initially now to FIGS. 1 through 6, a preferred embodiment of my Hand-held log splitter been generally designated by the reference numeral 20. Splitter 20 includes a handle 22, to be hereinafter to be described in detail, which can be manually grasped by a typical workman 24 to split wood such as log 26. In the preferred embodiment the implement is reciprocated upwardly and downwardly as respectively indicated the arrows 28 and 29 in FIGS. 1 and 2. In each of its various embodiments the splitter 20 can be removably connected to different tools. In FIGS. 1–6, a rigid, generally wedge shaped tool 30 is illustrated for directly contacting and splitting logs 26. As hereinafter described, other workpiece-engaging tools may be used with my invention, so it is not limited to log splitting.

With additional reference now directed to FIGS. 7–11, my tool comprises a rigid, elongated tool control shaft 40 which is removably, threadably coupled to a selected tool 30. Shaft 40 is coaxially received within an outer, rigid sleeve 46 to which the handle structure 22 is mounted. The top of the sleeve has been designated by the reference numeral 50. The bottom of the sleeve has been designated by the reference numeral 51 (FIGS. 6–9). The bottom 41 of the shaft 40 is threadably coupled to the tool 30 for a quick connection or disconnection as hereinafter described.

Shaft 40 is coaxially, telescopingly mated within outer sleeve 46. When the apparatus is retracted (i.e., FIG. 9) the top 42 of shaft 40 is disposed adjacent sleeve top 50. As best viewed by comparing FIGS. 7–10, for example, the shaft 40 and the sleeve 46 are axially displaceable with respect to one another. The sleeve 46 may be reciprocated upwardly and downwardly relative to the shaft. When the sleeve 46 is driven downwardly to the impact position, as in FIG. 9, the shaft, while telescopingly received within the sleeve, is driven downwardly by impact into the workpiece.

A vent hole 43 disposed within sleeve 46 adjacent weight 60 allows air to be evacuated between the sleeve weight 60 and the shaft top 42 during operation. In the upward stroke, illustrated in FIG. 1, air is drawn into the annulus 68 through the orifice 43. In the downward stroke air is exhausted through the annulus to depressurize the chamber resulting between the coaxially moving parts.

Rigid sleeve 50 preferably comprises an elongated piece of steel pipe. Coaxially fitted within sleeve top 50 is a weight 60 which seals top 50. Weight 60 periodically impacts shaft 40 during tool use, hitting the top 42 of shaft 40 when the sleeve is reciprocated downwardly. As relative coaxial sliding and telescoping movement occurs, alignment is maintained by a pair of guides 64 and 66 (i.e., FIGS. 9–11). The guide structure and arrangement is important to prevent twisting and binding forces from jamming the invention. It is very important that all moving parts be maintained coaxially and truly centered.

Accordingly, an upper guide 64 is coaxially secured to the top 42 of the shaft. Guide 64 moves with the shaft 40 within sleeve 46. The guide substantially coaxially occupies annulus 68 formed between the shaft 40 and the sleeve 46. Upper guide 64 is coaxially slidable within annulus 68 and it travels within the annulus upwardly and downwardly with respect to the sleeve as indicated in FIG. 10.

The second, lower guide 66 is coaxially secured within the sleeve at its bottom 51. Lower guide 66 is coaxially disposed within the annulus 68 between shaft 40 and sleeve body 46. It is coaxially penetrated by the shaft 40. When the sleeve is lifted upwardly (i.e., FIG. 10), guide 64 will contact guide 66, preventing disassociation of the shaft 40 from sleeve 46.

Importantly, locking means 80 can temporarily maintain the implement in a safe transportation position. As best seen in FIG. 11, locking means 80 preferably comprises a generally "L" shaped lever 84 which is twistably operated. Lever 84 includes a handle portion 87 adapted to be grasped by a workman to twist the locking means between secured and loose positions. A threaded, integral shank 89 is mated to the threaded passageway 90 presented by bolt 94 welded to the sleeve. This passageway extends through the bottom 51 of the sleeve and the lower guide 66. An intermediate jam nut 94 is included to lock the apparatus to positively jam the locking mechanism into a locking position during transportation. When the lock 84 is properly secured, the threaded shank 89 frictionally contacts internal shaft 40 to prevent relative telescoping displacement between the sleeve and the shaft. Of course, locking mechanism 80 must be "unlocked" in order to free the device 20 for usage.

In each of the embodiments, the various tools 30, 30A (FIGS. 7, 8), 30B (FIG. 9, 9*a*) and 30C (FIGS. 10, 10*a*) are quick coupled to the apparatus. A quick release collar means 100 is preferably employed to interconnect the various tools with the apparatus. Each of the tools 30–30C terminates in an upper nut 102 which receives a threaded stub 103 projecting downwardly from the bottom 41 of shaft 40. Stub 103 is thus threadably received within nut 102 comprising part of the quick release means 100. An intermediate jam nut 104 and lock washer 105 (FIG. 11) are captivated upon stub 103. When installing the various tools, stub 103 is turned tightly into nut 102 whereupon jam nut 104 is tensioned against washer 105 and nut 102, and the chosen tool is permanently affixed.

The preferred log splitting wedge 30 is best seen in FIGS. 1–6. Tool 30 is generally wedge-shaped as revealed in FIGS. 3 and 6, terminating in a sharp lower point 110 adapted to initially engage and split the wood as indicated in FIGS. 1 and 2. The bottom edge 111 (FIGS. 4) is generally flat. The opposite tool sides 112 (FIGS. 4, 6) taper downwardly to sharpened edge 111. A pair of relief slots 114 defined in sides 112 make it easier to withdraw the wedge when it is temporarily jammed within the log or workpiece. Although tool 30 is ideal for splitting wood, I have found that it works with a variety of other items as well. However, it is recommended that the alternative tools 30A–30C be considered as well.

Figure 7:
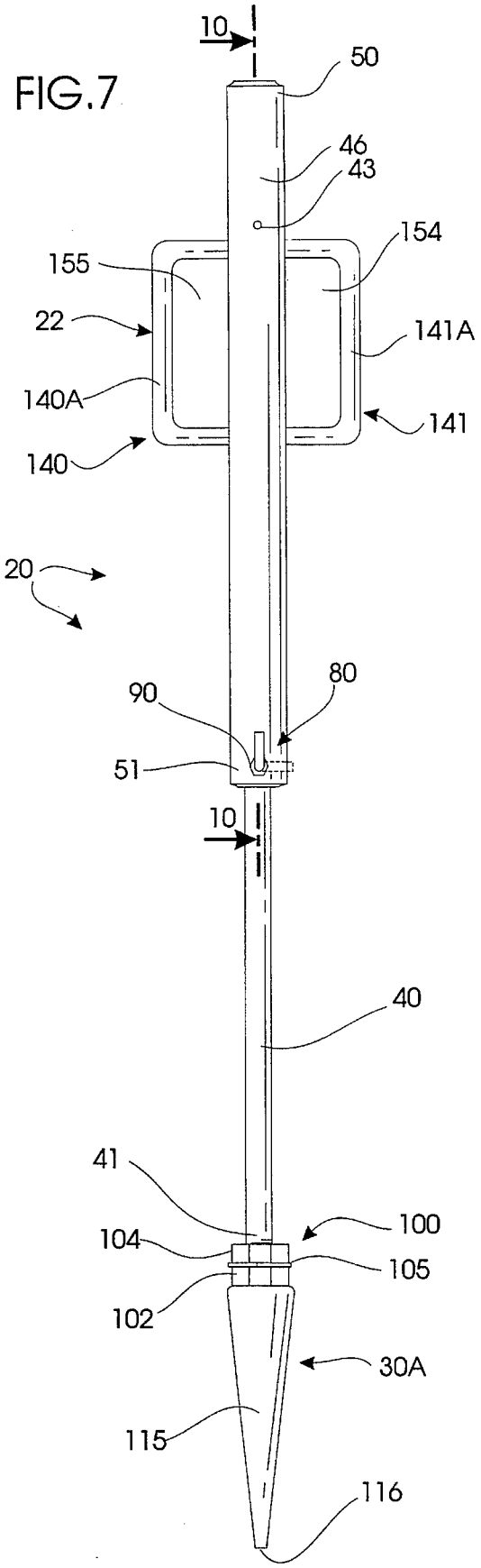
FIG. 7 is a front elevational view similar to FIG. 3, but showing the pieces telescoped apart, and illustrating an alternative impact tool (i.e., a root cutter)
Figure 8:
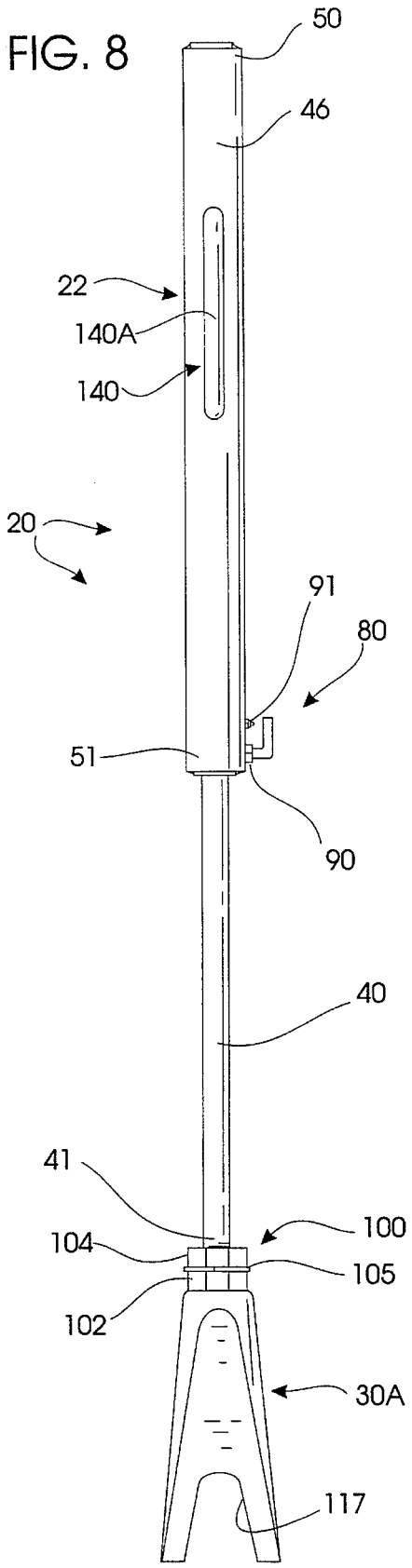
FIG. 8 is a side elevational view taken generally from the left of FIG. 7.

Turning now to FIG. 7 and 8, an alternative tool 30A has a generally wedge-shaped body 115 which terminates in a relatively blunt point 116. Importantly, a notch 117 (FIG. 8) is defined beneath wedge 30A to circumscribe a root or the like, Tool 30A is ideally adapted to cutting tree roots.

Figure 9:
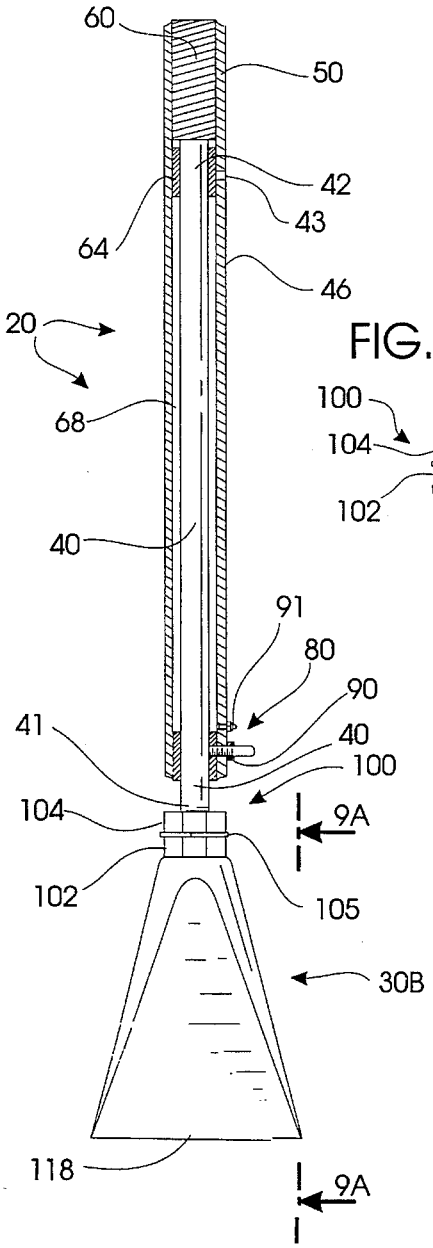
FIG. 9 is a longitudinal sectional view of the tool taken generally along line 9—9 of FIG. 3, but showing an alternative impact tool.
Figure 9A:
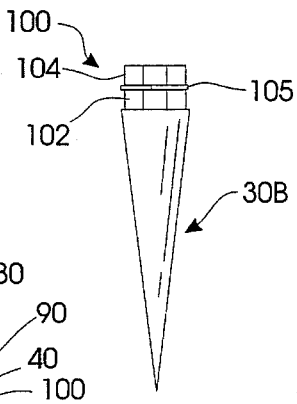
FIG. 9A is an elevational view taken generally along line *9a—9a* of FIG. 9.

Turning to FIGS. 9 and 9A, the cutting wedge 30B is ideal for "softer" targets such as pine. Tool 30B also has a wedge-shaped profile as illustrated in FIG. 9A. However, its lower cutting edge 118 (FIG. 9) is larger and broader the cutting edge 111 (FIG. 4) previously described. I have found tool 30B ideal for breaking up relatively loose, partially disintegrated debris such as old pavement, rotted trees and the like.

Figure 10A:
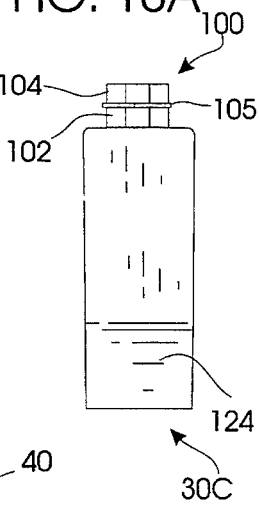

Turning to FIGS. 10–10A, alternative tool 30C comprises a relatively heavyweight, pointed hammer having solid body 122 terminating in a relatively short, wedged portion 124. The hammer 30*c* is ideal for breaking up small portions of asphalt and concrete sidewalks and the like.

The preferred handle 22 comprises a pair of generally "C" shaped members 140 and 141 having horizontal portions 140A and 141A (FIG. 7) adapted to be manually grasped by a user. Workman 24 may simply place his hands within either of the enclosed regions 154, 155 and grip an adjacent handle portions 140A, 141A.

An alternative handle construction 22A is seen in FIG. 13. Here, instead of a single "C" shaped portion, there are three spaced apart portions to receive the hands of the user of different heights. Alternative handle 22A (FIG. 13) includes a pair of parallel, spaced apart vertical rails 160, 161 which are secured to the sleeve 46 by a plurality of spaced apart, horizontal braces 164–167. Three distinct pairs of compartments thus exist; these pairs are respectively designated by the reference numerals 170, 171 and 172 (FIG. 13). Depending upon the orientation of the worker, where he is standing, and the type of object being impacted, a worker will be able to efficiently grasp and control the apparatus.

OPERATION

The device should be locked for safe transportation to the intended location. During transportation it is important that the locking mechanism 80, previously described, be satisfactorily tight. To lock the apparatus, the locking handle 87 is forcibly rotated until the shaft bottom 41 is forcibly jammed with the sleeve to prevent inadvertent dislodging. When arriving at the work site, the lock may be easily opened once the appropriated tool is selected.

Tool selection includes the tools 30, 30A, 30B and 30C, previously described. Normally for splitting wood, wedges 30 or 30B are appropriate. For splitting younger, hardwoods the smaller dimensioned wedge 30 (FIG. 1 and 2) is recommended.

The selected wedge is removed through the quick connect/disconnect collar means 100, described previously. By taking an appropriate wrench, jam nut 104 can be dislodged from frictional engagement with the collar means nut 102 secured to the tool.

Then the operator should orient himself in a safe and convenient orientation. It is important that the operator stand in stable position, and that he use both hands for the job. Once the selected tool engages the workpiece (i.e., wedge 30 starts to engage log 26) tool 30 will become relatively, firmly locked within the workpiece.

As the handle is tightly grasped, the sleeve may be repeatedly moved upwardly and downwardly. Slow, deliberate movement is important. At this time stability is increased because the upper and lower guides cooperate to maintain everything in coaxial alignment as the parts telescopingly extend and retract. As relative displacement between the sleeve and the shaft occur, the shaft 40 slides within the lower guide 66 fixed at the bottom of the sleeve. Similarly, the upper guide 64 secured to the top of the shaft slides within the sleeve interior. To facilitate this movement, grease can be injected through nipple 91. Also, relatively small quantities of lubricating oil be periodically injected through vent hole 43.

Ease of use is enhanced by the fact that the weight 60 is disposed substantially on top of the sleeve, and contacts the top of shaft 40 rather than the bottom. As best viewed in FIG. 2, when the weight impacts the shaft, the point of impact will be adjacent the hands of the user, where the shock forces can be most easily braced and maintained. Further, since the weight point of impact is on top of the apparatus shaft 40, I have found that kinetic energy is more readily transferred since it readily distributes into the workpiece through the construction disclosed. In other words, it is much easier to "hit the sweet spot" and my apparatus does not leave one's hand "ringing" from impact.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hand-held log splitter comprising:

a rigid wedge adapted to be forcibly driven into a log for penetrating and splitting it;

a rigid, elongated tool control shaft fastened to said wedge and extending upwardly therefrom, said shaft comprising a top and bottom;

quick release collar means for releasably joining said wedge to said shaft;

a rigid, elongated, sleeve coaxially, telescopingly receiving said shaft, said sleeve having a top and a bottom;

a weight fixedly disposed coaxially within said sleeve at said sleeve top for forcibly contacting said shaft top when said sleeve is moved maximally axially downwardly;

an annulus formed between said shaft and said sleeve;

an upper guide coaxially disposed within said annulus and fixed to said shaft top, said upper guide slidably received within said sleeve;

a lower guide spaced apart from said upper guide and coaxially disposed within said annulus, said lower guide fixedly secured within said sleeve bottom and coaxially, slidably penetrated by said shaft;

means for selectively locking said shaft relative to said sleeve to safely configure said splitter for transportation wherein said locking means threadably penetrates said sleeve and said lower guide;

handle means projecting from said sleeve for operating said splitter; and, whereby said sleeve may be axially reciprocated with respect to said shaft to drive said wedge into said log when said weight forcibly impacts said shaft top.

2. The splitter as defined in claim 1 wherein said shaft comprises a threaded stub projecting downwardly and said collar means comprises a first nut rigidly secured to said wedge for receiving said stub, and a jam nut threaded to said stud for frictionally, torsionally locking against said first nut.

3. The splitter as defined in claim 1 further comprising an orifice for venting said annulus in response to movement.

4. A hand-held implement comprising:

a rigid tool adapted to be forcibly driven into a workpiece;

a rigid, elongated tool control shaft fastened to said tool and extending upwardly therefrom, said shaft comprising a top and a bottom and a threaded stub projecting downwardly from its bottom;

collar means for removably coupling said shaft to said tool, said collar means comprising a first nut rigidly secured to said implement for receiving said stub, and a jam nut threaded to said stud for frictionally, torsionally locking against said first nut;

a rigid, elongated, sleeve coaxially, telescopingly receiving said shaft, said sleeve having a top and a bottom;

a weight fixedly disposed coaxially within said sleeve at said sleeve top for forcibly contacting said shaft top when said sleeve is moved maximally axially downwardly;

an annulus formed between said shaft and said sleeve;

an upper guide disposed within said annulus and fixed to said shaft adjacent said shaft top, said upper guide slidably received within said sleeve;

a lower guide spaced apart from said upper guide disposed within said annulus, said lower guide fixedly secured within said sleeve bottom and slidably penetrated by said shaft and operable to prevent separation of said shaft from said sleeve by contact with said upper guide when said sleeve and shaft are telescoped apart;

locking means penetrating said sleeve for locking said shaft relative to said sleeve to safely configure said implement for transportation, said locking means threadably penetrating said sleeve and said lower guide;

an orifice for venting said annulus in response to sleeve movement;

handle means projecting from said sleeve for operating said implement; and, whereby said sleeve may be axially reciprocated with respect to said shaft to drive said tool into said workpiece when said weight forcibly impacts said shaft.

5. The implement as defined in claim 4 wherein said handle means comprises two separate elongated, rigid, generally C-shaped coplanar handles, said handles fixed to and projecting outwardly from said sleeve.

6. The implement as defined in claim 4 wherein said tool comprises a solid, rigid wedge for splitting wood.

7. The implement as defined in claim 4 wherein said tool comprises a pointed hammer for breaking up pavement.

8. The implement as defined in claim 4 wherein said tool comprises a rigid, notched wedge for cutting tree roots and the like.

9. A hand-held impact implement for manual use, said implement comprising:

a rigid, removable tool adapted to be forcibly driven into a workpiece, said tool selected from the group consisting of:

a rigid wedge for splitting wood;

a pointed hammer for breaking up pavement; and, a rigid, notched wedge for cutting tree roots;

a rigid, elongated tool control shaft removably fastened to said tool and extending upwardly therefrom, said shaft comprising a top and a bottom and a threaded stub projecting downwardly from said bottom;

quick release collar means for threadably joining said tool to said shaft and said collar means comprises a first nut rigidly secured to said tool for receiving said stub, and a jam nut threaded to said stud for frictionally, torsionally locking against said first nut;

a rigid, elongated, sleeve coaxially, telescopingly receiving said shaft, said sleeve having a top and a bottom;

a weight fixedly disposed coaxially within said sleeve at said sleeve top for forcibly contacting said shaft top when said sleeve is moved maximally axially downwardly;

an annulus formed between said shaft and said sleeve;

an upper guide coaxially disposed within said annulus and fixed to said shaft adjacent said shaft top, said upper guide slidably received within said sleeve;

a lower guide spaced apart from said upper guide and coaxially disposed within said annulus, said lower guide fixedly secured within said sleeve bottom, said lower guide coaxially, slidably penetrated by said shaft and operable to prevent separation of said shaft from said sleeve by contacting said upper guide when said sleeve and said shaft are telescoped apart;

handle means projecting from said sleeve for operating said implement;

means for selectively locking said shaft relative to said sleeve to safely configure said implement for transportation said locking means threadably penetrating said sleeve and said lower guide;

an orifice for venting said annulus; and, whereby, after said locking means is unlocked, said sleeve may be manually axially reciprocated with respect to said shaft to impact said tool and thus said workpiece when said weight forcibly impacts said shaft top.

10. The implement as defined in claim 9 wherein said handle means comprises two separate elongated, rigid, generally C-shaped coplanar handles, said handles fixed to and projecting outwardly from said sleeve.

11. The implement as defined in claim 9 wherein said handle means comprises two separate elongated, coplanar handles fixed to and projecting outwardly from said sleeve, each handle divided into separate vertically spaced apart sections for accommodating workman of different physical sizes.

* * * * *